US007451773B2

(12) United States Patent
Bang

(10) Patent No.: US 7,451,773 B2
(45) Date of Patent: Nov. 18, 2008

(54) DISHWASHER

(75) Inventor: Jong Chul Bang, Changwon-si (KR)

(73) Assignee: LG Electronics, Inc., Seoul (KR)

( * ) Notice: Subject to any disclaimer, the term of this patent is extended or adjusted under 35 U.S.C. 154(b) by 594 days.

(21) Appl. No.: 11/109,959

(22) Filed: Apr. 20, 2005

(65) Prior Publication Data

US 2005/0236020 A1 Oct. 27, 2005

(30) Foreign Application Priority Data

Apr. 22, 2004 (KR) ..... 10-2004-27839

(51) Int. Cl.
*B08B 9/093* (2006.01)
*G01F 23/30* (2006.01)

(52) U.S. Cl. ..... 134/158 D; 73/309; 73/1.31; 73/1.73

(58) Field of Classification Search ..... 134/158 D; 73/309

See application file for complete search history.

(56) References Cited

U.S. PATENT DOCUMENTS 4,964,421 A * 10/1990 Klaus ..... 137/460
5,770,058 A * 6/1998 Jozwiak ..... 210/167.31
2002/0020460 A1* 2/2002 Viken ..... 141/59
2003/0197387 A1* 10/2003 Dirnberger ..... 292/216

FOREIGN PATENT DOCUMENTS

| | | |
|---|---|---|
| DE | 29908565 U1 | 7/1999 |
| DE | 19841372 C1 | 2/2000 |
| EP | 0 958 777 | 11/1999 |

* cited by examiner

*Primary Examiner*—Frankie L Stinson
*Assistant Examiner*—Samuel A Waldbaum
(74) *Attorney, Agent, or Firm*—McKenna Long & Aldridge LLP

(57) ABSTRACT

The present invention provides a dishwasher, by which an appropriate quantity of water can be stably supplied. The present invention includes a sump storing water therein, a floater received in a chamber having a predetermined volume, the floater ascending according to a rise of a water level of the sump, a switch preventing the water from being oversupplied to the sump, a pushing member lifted by the floater to turn on the switch by pushing the switch, and an off-delay part delaying the switch to be turned off on a descent of the floater.

11 Claims, 4 Drawing Sheets

DISHWASHER

This application claims the benefit of the Korean Application No. P2004-27839 filed on Apr. 22, 2004 which is hereby incorporated by reference.

BACKGROUND OF THE INVENTION

1. Field of the Invention

The present invention relates to a dishwasher, to which water can be stably supplied.

2. Discussion of the Related Art

Generally, a dishwasher is an apparatus for washing dishes in a manner of spraying water at high pressure on dishes to remove garbage or filth from the dishes and drying the dishes.

A wash chamber for dishwashing is provided within the dishwasher. And, a sump storing water for the dishwashing therein and a pump pumping the water stored in the sump are provided within the dishwasher.

And, racks receiving dishes thereon are provided within the wash chamber. Specifically, the dishwasher includes an upper rack and a lower rack provided under the upper rack.

A top nozzle is provided over the upper rack and a lower nozzle is provided below the lower rack. Moreover, an upper nozzle is provided between the upper and lower racks.

The nozzles are connected to a water guide guiding the water discharged from the sump. And, the dishes received on the racks are washed by the water sprayed at high pressure via the nozzles.

However, a quantity of the water suitable for the dishwashing needs to be supplied to the above-configured dishwasher. Hence, many efforts are made to develop a dishwasher that can stably supply a sump with an appropriate quantity of water.

SUMMARY OF THE INVENTION

Accordingly, the present invention is directed to a dishwasher that substantially obviates one or more problems due to limitations and disadvantages of the related art.

An object of the present invention is to provide a dishwasher, to which water can be stably supplied.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a dishwasher according to the present invention includes a sump storing water therein, a floater received in a chamber having a predetermined volume, the floater ascending according to a rise of a water level of the sump, a switch preventing the water from being oversupplied to the sump, a pushing member lifted by the floater to turn on the switch by pushing the switch, and an off-delay part delaying the switch to be turned off on a descent of the floater.

Preferably, the off-delay part includes an elastic member provided between the pushing member and the floater.

More preferably, the elastic member includes at least one spring having a predetermined elastic modulus.

More preferably, the elastic member includes a first spring and a second spring provided in series to the first spring.

More preferably, the elastic member further includes a supplementary lever provided between the first and second springs.

More preferably, the switch includes a contact terminal elastically supported downward to return to an off-position.

Preferably, the pushing member comprises a floater lever provided under the switch to push the switch if the floater ascends to a predetermined height.

More preferably, the dishwasher further includes a partition wall provided between the switch and the floater wherein a perforated hole is provided in a vertical direction to the partition wall to be penetrated by the floater lever.

More preferably, the floater lever blocks the perforated hole of the partition wall to prevent a steam from flowing to the switch when the water level of the sump is below a predetermined level.

More preferably, the floater lever includes an upper end having a cross-sectional area greater than that of the perforated hole to block the perforated hole of the partition wall when the water level of the sump is below the predetermined level.

Preferably, the switch is turned on by the pushing member to input a drain signal of the water stored in the sump.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
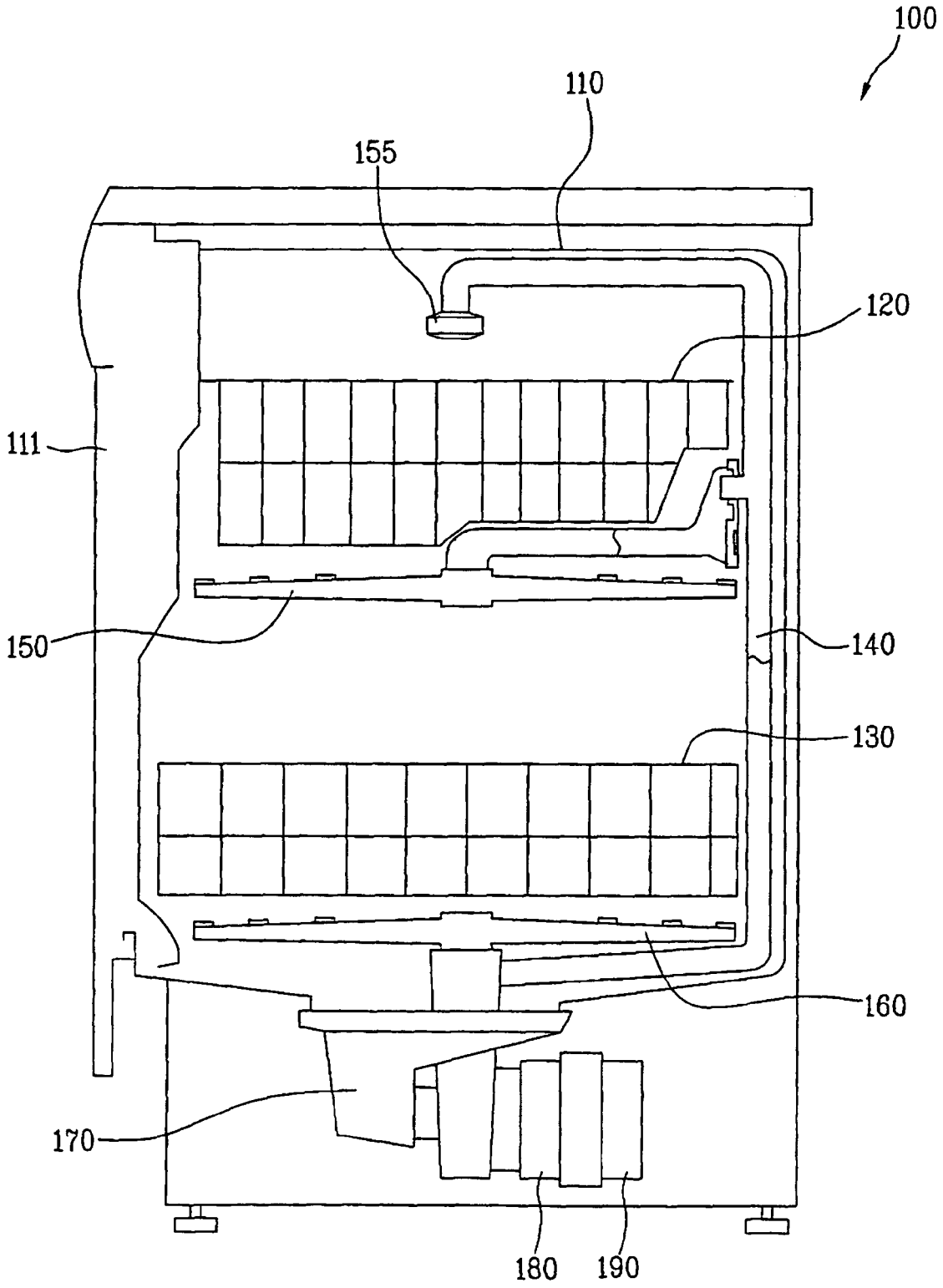
FIG. 1 is a cross-sectional view of a dishwasher according to one embodiment of the present invention.

FIG. 1 is a cross-sectional view of a dishwasher according to one embodiment of the present invention.

Referring to FIG. 1, a dishwasher 100 according to one embodiment of the present invention includes a tub 110, a door 111, a sump 170, and a pump 180.

The tub 110 forms an exterior of the dishwasher 100, and a wash chamber for washing dishes is provided within the tub 110.

The door 111 is provided to a front side of the tub 100 to open/close a front side of the wash chamber, and racks 120 and 130 are provided within the tub 110 to receive the dishes therein. Moreover, the sump 170 is provided in a lower portion of the tub 110 to store water therein.

The pump 180 is provided under the tub 110 to pump the water stored in the sump 170 at high pressure, and a motor 190 is provided in rear of the pump 180 to provide a drive force with the pump 180.

At least one racks 120 and 130 are provided within the tub 110, and more particularly, within the wash chamber to receive the dishes to be washed therein.

Specifically, an upper rack 120 is provided to an upper space of the tub 110 to receive the dishes and a lower rack 130 is situated below the upper rack 120.

Wheels (not shown in the drawing) are provided to bottoms of the upper and lower racks 120 and 130 and supported by rails (not shown in the drawing) provided to a lateral inside of the tub 110. Hence, the racks 120 and 130 are movable in back and forth direction by the wheels and rails.

A top nozzle 155 is provided over the upper rack 120 and an upper nozzle 150 is provided under the upper rack 120. Moreover, a lower nozzle 160 is provided under the lower rack 130.

The top, upper, and lower nozzles 155, 150, and 160, which are configured to spray water on the dishes received in the upper and lower racks 120 and 130, are connected to a water guide 140 guiding the water pumped by the pump 180.

The top nozzle 155 is configured to spray the water downward, whereas the upper and lower nozzles 150 and 160 are configured to spray the water upward.

Alternatively, the upper nozzle 150 can be configured to spray the water upward and downward.

An operation of the above-configured dishwasher is explained as follows.

First of all, a user opens the door 111 of the dishwasher 100, draws the upper and lower racks 120 and 130 out of a front side of the tub 110, and then puts dishes on the racks 120 and 130.

The door 111 is closed and power is then applied to the dishwasher 100. If so, water is supplied to the sump 170 to execute a washing cycle.

After an appropriate quantity of water has been introduced into the sump 170, the motor 190 is actuated to drive the pump 180.

The water pumped by the pump 180 is led to the nozzles by the water guide 140 and is then sprayed on the dishes received on the racks to wash the dishes.

In doing so, the top nozzle 155 sprays the water downward, the upper nozzle 150 sprays the water upward and downward, and the lower nozzle 160 sprays the water upward, whereby the dishes received on the respective racks 120 and 130 are washed.

After completion of the washing cycle, the used or polluted water recovered to the sump 170 is filtered by a filter (not shown in the drawing). And, the water is discharged outside the dishwasher 100 via a drain pump (not shown in the drawing).

Subsequently, in order to enter a rinsing cycle for rinsing the washed dishes, clean water is introduced into the sump 170. The introduced clean water is sprayed on the dishes via the nozzles in the same manner of the washing cycle to rinse the dishes.

After completion of the rinsing cycle, a drying cycle of drying the dishes is executed to dry the dishes.

Figure 2:
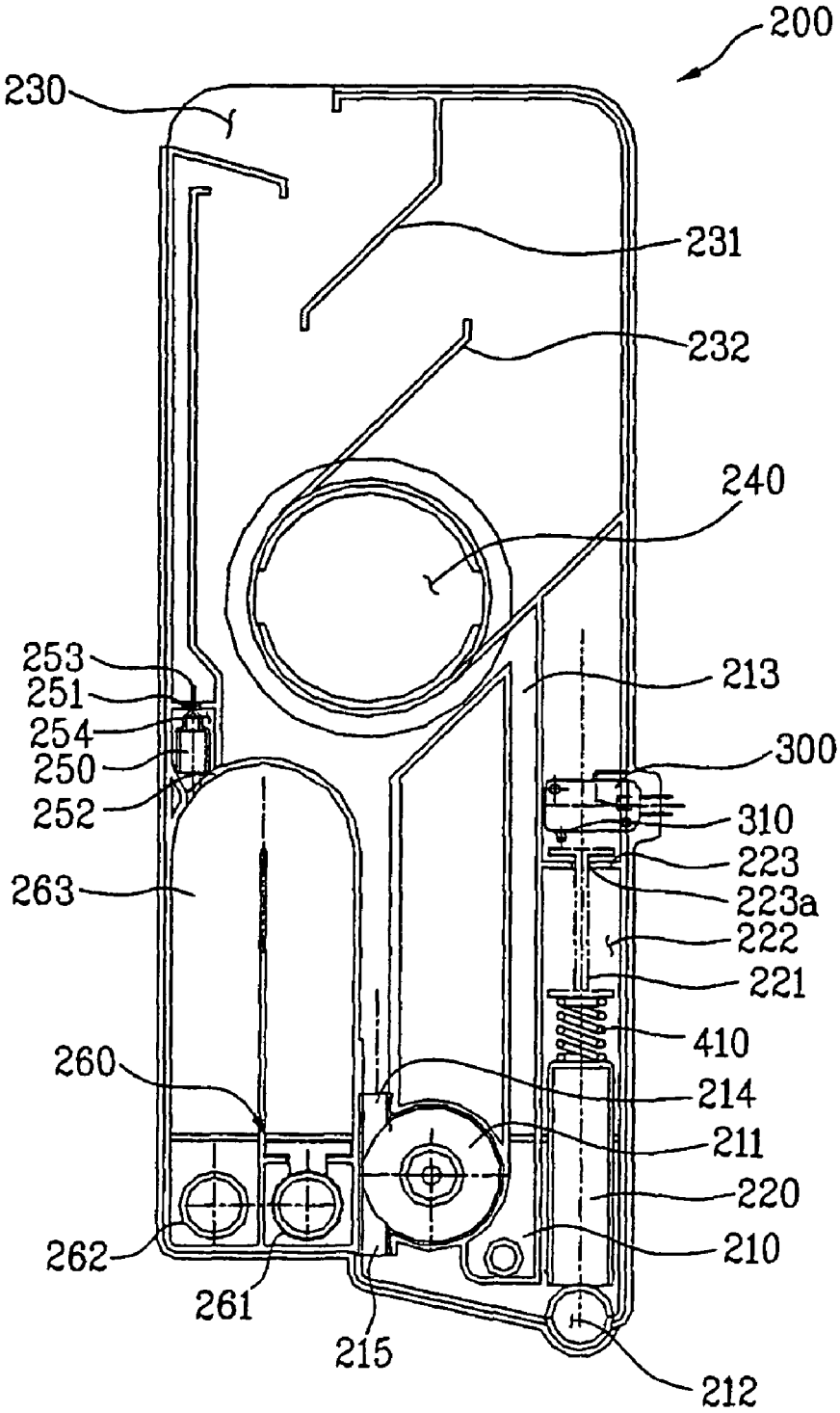
FIG. 2 is a cross-sectional view of an airbrake provided to a dishwasher according to one embodiment of the present invention.

FIG. 2 is a cross-sectional view of an airbrake provided to a dishwasher according to one embodiment of the present invention, in which the airbrake adjusts a quantity of water supplied to the sump 170.

Referring to FIG. 2, an airbrake 200 is provided to one side of the dishwasher 100, and more particularly, to one lateral side of the tub 110 to supply water to the sump 170 and to adjust a quantity of the water supplied to the sump 170.

More Preferably, The airbrake 200 is provided to outer side of the tub 110 so as to prevent a volume of the wash chamber for washing dishes.

The airbrake 200 includes a water supply hose connecting portion 210, a flow meter 211, and a water supply passage 213.

The water supply hose connecting portion 210 is provided to one lower side of the airbrake 200 to communicate with the water supply passage 213.

The water supply passage 213 extends upward from the water supply hose connecting portion 210 and then extends downward to configure an 'inverse-U' type cross-section overall.

The water supplied via the water supply hose connecting portion 210 passes through the upward-extending section of the water supply passage 213 and then falls down from the downward-extending section of the water supply passage 213. And, the flow meter 211 is provided to the downward-extending section to measure flux of the water.

Namely, the supplied via the water supply hose connecting portion 210 is led to an upper side along the water supply passage 213 and then falls down from an upper end of the water supply passage 213 to pas through the flow meter 211.

The flow meter 211 includes an impeller (not shown in the drawing) having a magnet (not shown in the drawing) attached to one side thereof.

Once the impeller collides with the falling water to rotate, pulses are generated according to variations of a magnetic field formed around the magnet. And, the number of the pulses is detected to measure the flux of the water.

Meanwhile, since the impeller of the flow meter 211 fails to rotate accurately at a low water pressure, it is preferable that pressure of the falling water is increased by the water falling downward and passing through the flow meter 211.

Namely, the impeller provided within the flow meter 211 is rotated by a shock impacted on the impeller by the free-falling water. For this, an inlet 214, via which the water is introduced into the flow meter 211, is provided to an upper side of the flow meter 211 and an outlet 215, via which the water is discharged, is provided to a lower side of the flow meter 211.

The outlet 215 communicates with a sump connecting portion 212 connected to the sump 170. Hence, the water discharged from the outlet 215 of the flow meter 211 is supplied to the sump 170 via the sump connecting portion 212.

An air intake 230 is provided to an upper corner of the airbrake 200, and external air is introduced into the airbrake 200 via the air intake 230.

To make the air intake 230 communicate with the wash chamber of the dishwasher 200 mutually, a communicating hole 240 communicating with the wash chamber is formed at a central part of the airbrake 200.

Regardless of an operation of the dishwasher 100, the external air is introduced into the dishwasher 100 via the communicating hole 240 that communicates with the air intake 230.

To prevent noise, which is generated from an inside of the wash chamber, from propagating outside through the air intake, first and second guide walls 231 and 232 parallel to each other are provided over the communicating hole 240 to leave a gap in-between.

Preferably, the first and second walls 231 and 232 are tilted to guide a flow of air and to minimize the noise propagation.

Meanwhile, a drain passage 263 is provided to a lower part of the airbrake 200. A drain connecting portion 261 and a drain hose connecting portion 262 are connected to one side and the other side of the drain passage 263, respectively to communicate with each other.

The water after completion of the washing is introduced into the drain passage 263 via the drain connecting portion 261 by the driven drain pump (not shown in the drawing) provided to one side of the sump 170. The water introduced into the drain passage 263 is discharged outside via a drain hose (not shown in the drawing) connected to the drain hose connecting portion 262.

To prevent the water, which is moving along the drain passage 263, from flowing backward to the drain pump when the drain process of the water is interrupted, a first check valve 260 is provided to an upper side of the drain connecting portion 261.

In addition to the above configuration, to prevent the water from being continuously discharged by a siphon phenomenon after the interruption of driving the drain pump, a siphon preventing portion is provided to an upper side of the drain passage. The siphon preventing portion includes a siphon preventing chamber 254 and a second check valve 250.

Specifically, the second check valve 250 is received within the siphon preventing chamber 254. First and second perforated holes 251 and 252 are formed at upper and lower ends of the siphon preventing chamber 254, respectively. The first perforated hole 251 communicates with the air intake 230 and the second perforated hole 252 communicates with the drain passage 252.

A support shaft 253 is projected from an upper end of the second check valve 250 to guide a vertical movement of the second check valve 250. The support shaft 253 is movable along the first perforated hole in upper and lower directions.

Once the water stops being drained, a portion of the air introduced via the air intake 230 is introduced into the siphon preventing chamber 254 and the drain passage 263 via the first and second perforated holes 251 and 252 to form an atmospheric pressure state. Hence, the siphon phenomenon is prevented from occurring.

The second check valve 250 is formed of a floating waterproof material. Preferably, the second check valve 250 is configured to have a conical shape of which upper end is pinnacled. Hence, the second check valve is moved upward to seal the first perforated hole 251.

Meanwhile, to detect a water level that rises when the sump 170 is filled with water, a water level detecting device is preferably provided to the airbrake 200 of the dishwasher according to the present invention.

Figure 3:
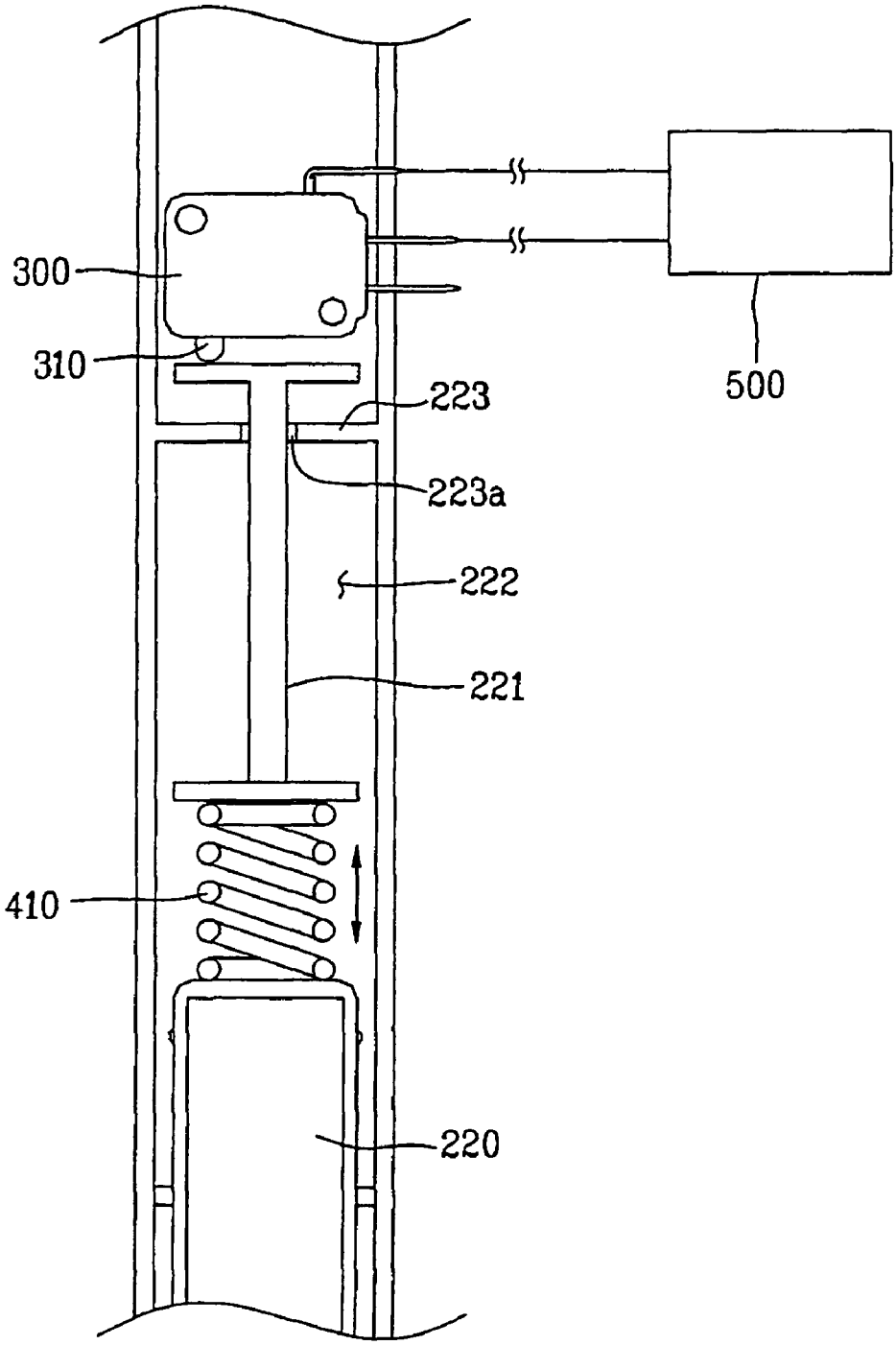
FIG. 3 is a magnified cross-sectional view of a water level detector provided to a dishwasher according to one embodiment of the present invention.

One embodiment of a water level detector provided to the dishwasher 100 according to the present invention is explained with reference to FIG. 2 and FIG. 3 as follows.

The water level detector includes a floater 220 and a pushing member vertically movable by the floater 220.

The floater 220, which is received in a floater chamber 222 having a predetermined size, is provided over the sump connecting portion 212 and is configured to ascend according to a rise of a water level of the sump 170.

Specifically, the floater 220, as shown in the drawings, is situated on a passage via which the water is supplied to the sump 170 so that particles or soil attached to a bottom of the floater 220 can be removed by a water flow. Hence, the water level within the wash chamber is prevented from being incorrectly detected.

The pushing member, which is provided movable in upward and downward direction by the floater 220, is configured to push a switch for preventing the water from being oversupplied to the sump 170. Particularly, the switch is a micro switch 300.

Specifically, the pushing member is configured to turn on the micro switch 300 by pushing a contact terminal 310 projected downward from a bottom of the micro switch 300.

For this, the pushing member includes a floater level 221 provided under the micro switch 300. Hence, the floater level 221 presses the switch when the floater 220 is raised to a predetermined height.

In other words, the floater lever 221 is provided over the floater 220 to be vertically movable according to the vertical motion of the floater 220.

If the contact terminal 310 of the micro switch 300 is pressed by the floater lever 221 to turn on the micro switch 300, the water stops being introduced into the dishwasher 100 and the drain pump 500 is actuated to discharge the water outside. Hence, the water leakage accident caused by oversupply of water can be prevented.

Optionally, although not shown in the drawing, the contact terminal 310 of the micro switch 300 can be configured to return to its off-position by having its upper end supported elastically in a lower direction by an elastic body.

Meanwhile, to heat the water supplied to the sump 170, a heater (not shown in the drawing) is preferably provided within the sump 170.

To prevent a malfunction of the micro switch 300 due to a steam generated from the water heated by the heater, a partition wall 223 is preferably provided between the floater 220 and the micro switch 300.

A perforated hole **223*a* is provided to the partition wall 223 in a vertical direction to be penetrated by the floater lever 221**.

The floater lever 221, which is movable in the vertical direction via the perforated hole **223*a* formed at the partition wall 223, minimizes a flow of the steam from the floater chamber 222 to the micro switch 300**.

Moreover, the floater lever 221 is preferably configured to block the perforated hole **223*a* at the partition wall 223 in case that the water level of the sump 170** is below a predetermined level.

For this, the floater lever 221 includes an upper end having a cross-section area bigger than that of the perforated hole **223*a*. The upper end of the floater lever 221 is preferably configured to block the perforated hole 223*a* at the partition wall 223 in case that the water level of the sump 170** is equal to or lower than a predetermined level.

Namely, if the water level of the sump 170 is below the predetermined level, the upper end of the floater lever 221 is supported by the partition wall 223 and blocks the perforated hole **223*a* and a lower end of the floater lever 221** becomes a free end.

Before the water is supplied, the upper end of the floater 220 leaves a predetermined interval from the lower end of the floater lever 221. Hence, the length of the floater 220 is variable to freely cope with a variation of the volume of the water received in the sump.

More preferably, the water level detector further includes an off-delay part to delay a turn-off state of the micro switch 300 in case of a descent of the floater 220.

Hence, a turn-on state of the micro switch 300 is sustained for a predetermined time to raise a discharged water quantity of the sump 170.

The off-delay part may include an air or oil pressure device or may be configured to generate a friction between the floater lever 221 and an inner wall of the floater chamber 222. Hence, the off-delay part can sustain the pressed state of the contact terminal 310 of the micro switch for the predetermined time.

Alternatively, the off-delay part in the present embodiment includes an elastic member provided between the floater lever 221 and the floater 220.

The elastic member includes a spring 410 having a predetermined elastic modulus and length. The elastic member is operative in sustaining the contact state between the floater lever 221 and the contact terminal 310 for the predetermined time even if the floater 220 is lowered due to the actuation of the drain pump 500.

The spring 410 prolongs a contact time between the floater lever 221 and the contact terminal 310 to reduce the number of actuations of the drain pump 500. Hence, power consumption thereof is reduced and endurance of the drain pump 500 is raised.

Specifically, in case that the water is oversupplied to the sump 170, the floater lever 221 pushes the contact terminal 310 and simultaneously the spring 400 is compressed.

If the micro switch 300 is turned on, the drain pump is actuated to drain the water of the sump 170. Hence, the floater lever 221 is lowered 221.

Once the floater lever 221 is lowered, the micro switch 300 is turned off to stop the actuation of the drain pump 500.

In doing so, the spring 410 is gradually elongated to return to its original position and length and keeps pushing the floater lever 221 upward. Namely, even if the spring 400 is elongated 400 due to the descent of the floater 220, the contact state between the contact terminal 310 and the floater lever 221 is sustained by the spring 410 during the predetermined time. Hence, the time of driving the drain pump 500 is prolonged.

Therefore, it is able to prevent a chattering phenomenon of repeating to turn on an off the drain pump 500 with a short timing interval. In this case, the chattering phenomenon was caused by the interrupted operation of the drain pump and the backdraft of water to the sump 170 due to the micro switch 300 immediately turned off according to the descent of the floater 220.

An operation of the above-configured airbrake 200 provided to the dishwasher according to the present invention is explained in detail as follows.

First of all, once power is applied to the dishwasher 100, the water introduced via the water supply hose connecting portion 210 is moved along the water supply passage 213.

The water having moved along the water supply passage 213 falls downward to rotate the impeller provided within the flow meter 211. And, the pulses generated according to the rotation of the impeller are transferred to the microcomputer to compute the flux of the water.

The water having passed through the flow meter 211 is supplied to the sump 170 via the sump connecting portion 212.

As the water level of the sump 170 is raised by the water supplied to the sump 170, the floater 220 rises as well. As the floater 20 is rising 220, both of the floater lever 221 and the spring 410 are rising.

If the contact terminal 310 of the switch 300 is pressed by the floater lever 221 arriving at a predetermined height, a water oversupply signal is inputted to the microcomputer from the micro switch 300 to stop the water supply. In doing so, the spring 410 is compressed to a predetermined length.

If the water oversupply signal is inputted, the drain pump 500 is actuated to execute the drain of the water within the sump 170. In doing so, the microcomputer can be programmed to generate a warning signal such as a warning sound and a warning light.

In the water drain process, the spring 410 is operative in sustaining the turned-on state of the micro switch 300 during a predetermined time.

Meanwhile, once a washing cycle is executed after completion of supplying the water, the water including garbage is recovered to the sump 170.

Once the drain pump is actuated to drain the polluted water, the water pumped by the drain pump is moved to the drain hose connecting portion 262 along the drain passage 263 connected to the drain connecting portion 261 and is then discharged outside via the drain hose connected to the drain hose connecting portion 262.

Moreover, a portion of the water moving along the drain passage 263 is introduced into the siphon preventing chamber 254 via the second perforated hole 252 by the water pressure to lift the second check valve 250. Hence, the conical upper end of the second check valve 250 seals the first perforated hole 251.

On the other hand, if the drain of the water is stopped, a quantity of the water flowing in the drain passage 263 is lowered so that the water remaining within the siphon preventing chamber 254 is discharged to the drain passage 263 via the second perforated hole 252. Hence, the second check valve 250 is lowered together to open the first perforated hole 251.

In doing so, external air introduced via the air intake 230 is introduced into the drain passage 263 via the first and second perforated holes 251 and 252 to prevent the occurrence of the siphon phenomenon.

Figure 4:
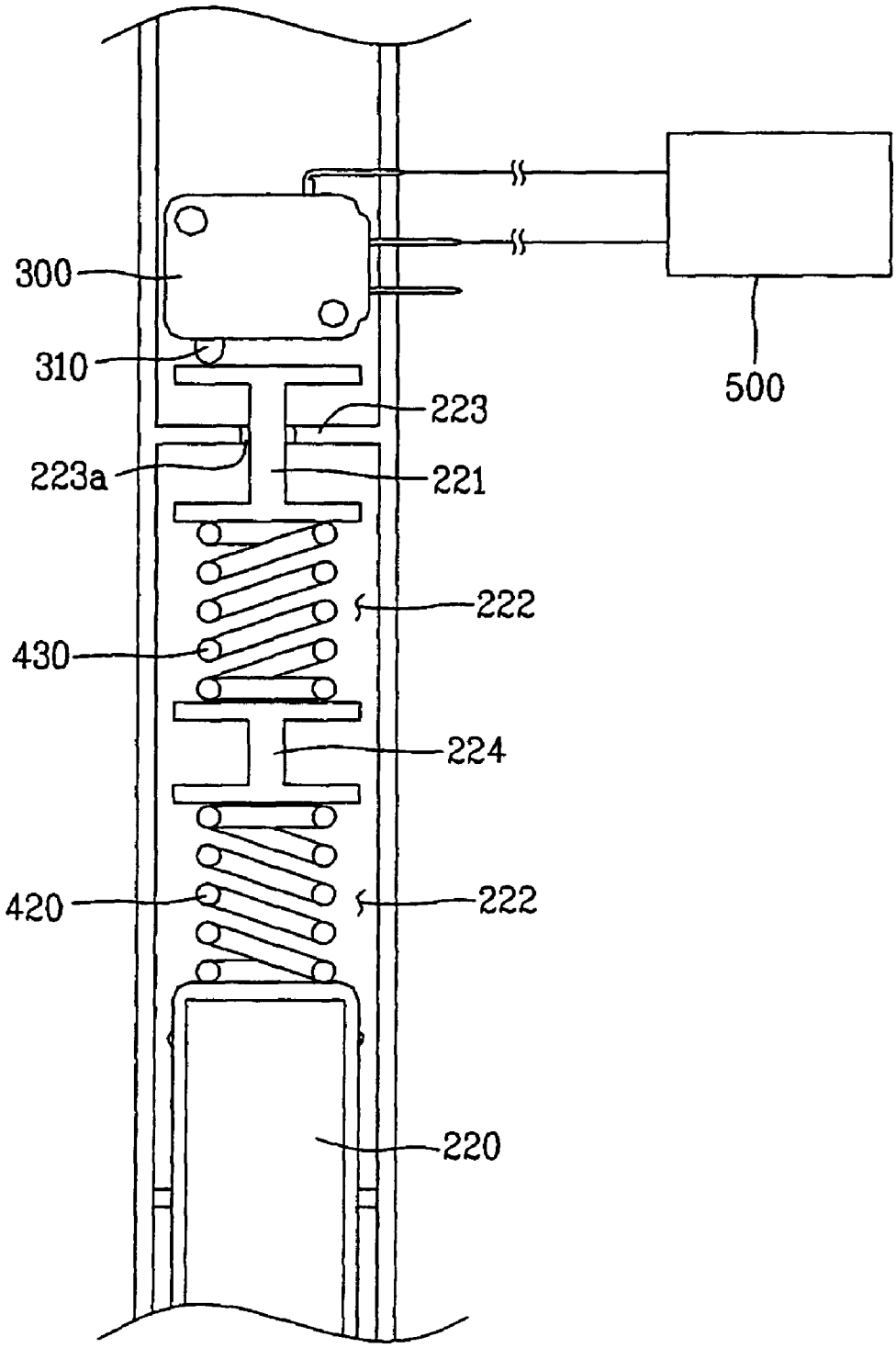
FIG. 4 is a magnified cross-sectional view of a water level detector provided to a dishwasher according to another embodiment of the present invention.

FIG. 4 is a magnified cross-sectional diagram of a water level detector provided to a dishwasher according to another embodiment of the present invention.

In the description of a water level detector provided to a dishwasher according to another embodiment of the present invention, the same reference numbers will be used throughout the drawings to refer to the same or like parts and their repeated explanation is skipped in the following.

Referring to FIG. 4, a water level detector provided to a dishwasher according to another embodiment of the present invention includes an off-preventing portion having at least two springs 420 and 430.

Specifically, the of-preventing portion includes a first spring 420 provided over the floater 220 and a second spring 430 provided between the first spring 420 and the floater lever 221.

In the present embodiment, the first and second springs 420 and 430 are arranged in series but are not limited to this configuration.

A supplementary lever 224 can be further provided between the first and second springs 410 and 430.

Hence, a contact time between the floater lever 221 and the contact terminal 310 can be prolonged.

Each of the springs 420 and 430 is configured to have a short length. A length of the floater lever 221 can be shortened. Yet, the lengths and numbers of the springs 420 and 430, the floater lever 310, and the supplementary lever 224 can be variously modified according to design conditions.

The dishwasher having the above-configured water level detector according to the present invention provides the following effects or advantages.

First of all, the airbrake is provided to the dishwasher to accurately measure the quantity of the water introduced into the dishwasher.

Secondly, the water level detector is provided to prevent the oversupply of the the water supplied to the dishwasher, whereby the water leakage accident due to the water oversupply can be prevented.

Finally, the off-delay part is provided to delay the occurrence of the turned-off state of the micro switch for a duration, whereby the chattering phenomenon is prevented from occurring in draining the water.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A dishwasher comprising:

a sump storing water therein;

a floater received in a chamber having a predetermined volume, the floater ascending according to a rise of a water level of the sump;

a switch preventing the water from being oversupplied to the sump;

a pushing member lifted by the floater to turn on the switch by pushing the switch; and an off-delay part including an elastic member delaying the switch to be turned off on a descent of the floater, wherein the elastic member contracts or expands substantially parallel to a functional direction of the floater.

2. The dishwasher of claim 1, wherein the elastic member is provided between the pushing member and the floater.

3. The dishwasher of claim 2, wherein the elastic member includes at least one spring having a predetermined elastic modulus.

4. The dishwasher of claim 2, the elastic member comprising:

a first spring; and a second spring provided in series to the first spring.

5. The dishwasher of claim 4, the elastic member further comprising a supplementary lever provided between the first and second springs.

6. The dishwasher of claim 2, wherein the switch includes a contact terminal projected downward at an off-position.

7. The dishwasher of claim 1, wherein the pushing member comprises a floater lever provided under the switch to push the switch if the floater ascends to a predetermined height.

8. The dishwasher of claim 7, further comprising a partition wall provided between the switch and the floater wherein a perforated hole is provided in a vertical direction to the partition wall to be penetrated by the floater lever.

9. The dishwasher of claim 8, wherein the floater lever blocks the perforated hole of the partition wall to prevent a steam from flowing to the switch when the water level of the sump is below a predetermined level.

10. The dishwasher of claim 9, wherein the floater lever comprises an upper end having a cross-sectional area greater than that of the perforated hole to block the perforated hole of the partition wall when the water level of the sump is below the predetermined level.

11. The dishwasher of claim 1, wherein the switch is turned on by the pushing member to input a drain signal of the water stored in the sump.

* * * * *